US010457446B2

(12) United States Patent
Willey

(10) Patent No.: US 10,457,446 B2
(45) Date of Patent: Oct. 29, 2019

(54) CONTAINMENT SYSTEM HAVING A ROTATABLE COVER

(71) Applicant: 2think, LLC, Fort Collins, CO (US)

(72) Inventor: Kevin E. Willey, Fort Collins, CO (US)

(73) Assignee: 2think, LLC, Windsor, CO (US)

( * ) Notice: Subject to any disclaimer, the term of this patent is extended or adjusted under 35 U.S.C. 154(b) by 43 days.

(21) Appl. No.: 15/942,335

(22) Filed: Mar. 30, 2018

(65) Prior Publication Data

US 2018/0282023 A1 Oct. 4, 2018

Related U.S. Application Data

(60) Provisional application No. 62/480,068, filed on Mar. 31, 2017.

(51) Int. Cl.

| | |
|---|---|
| ***B65D 25/00*** | (2006.01) |
| ***A45D 33/00*** | (2006.01) |
| ***B65D 25/04*** | (2006.01) |
| ***B65D 41/04*** | (2006.01) |
| ***A45C 11/00*** | (2006.01) |
| ***B65D 47/26*** | (2006.01) |

(52) U.S. Cl.

CPC ..... *B65D 25/005* (2013.01); *A45C 11/008* (2013.01); *A45D 33/00* (2013.01); *B65D 25/04* (2013.01); *B65D 41/04* (2013.01); *B65D 47/263* (2013.01); *A45C 2011/007* (2013.01)

(58) Field of Classification Search

CPC ..... B65D 25/005; B65D 25/04; B65D 25/10; B65D 41/04; A45C 11/008; A45C 11/00; A45D 33/00; A45D 33/22

USPC ..... 220/504, 503, 500, 676, 23.89, 23.87, 220/23.86, 253; 206/581; D9/737, 454, D9/435

See application file for complete search history.

(56) References Cited

U.S. PATENT DOCUMENTS 4,219,290 A * 8/1980 Golston ..... B65G 51/06 406/186

OTHER PUBLICATIONS

U.S. Appl. No. 62/480,068, filed Mar. 31, 2017.

* cited by examiner

*Primary Examiner* — Robert J Hicks
(74) *Attorney, Agent, or Firm* — Craig R. Miles; CR Miles P.C.

(57) ABSTRACT

A containment system, and methods of making and using such a containment system, whereby the containment system includes a container having a container sidewall disposed between opposing container first and second ends; a cavity disposed in the container sidewall; a cover concentrically disposed about the container sidewall; and an aperture element disposed in the cover, the aperture element defining an aperture element opening communicating between cover inner and outer surfaces. The cover is rotatable about the container sidewall between first and second positions. In the first position, the aperture element opening aligns with the cavity, thereby allowing access to the cavity. In the second position, a portion of the cover overlays the cavity to enclose the cavity.

20 Claims, 11 Drawing Sheets

1
27
8
9
25
29
3H
3I
8/13
12
4
3

CONTAINMENT SYSTEM HAVING A ROTATABLE COVER

This United States Non-Provisional patent Application claims the benefit of U.S. Provisional Patent Application No. 62/480,068, filed Mar. 31, 2017, hereby incorporated by reference herein.

I. SUMMARY OF THE INVENTION

A broad object of a particular embodiment of the invention can be to provide a containment system, and methods of making and using such a containment system, whereby the containment system includes a container having a container sidewall disposed between opposing container first and second ends; a cavity disposed in the container sidewall; a cover concentrically disposed about the container sidewall; and an aperture element disposed in the cover, the aperture element defining an aperture element opening communicating between cover inner and outer surfaces. The cover can be rotatable about the container sidewall between first and second positions. In the first position, the aperture element opening aligns with the cavity, thereby allowing access to the cavity. In the second position, a portion of the cover overlays the cavity to enclose the cavity.

Naturally, further objects of the invention are disclosed throughout other areas of the specification, drawings, and claims.

II. A BRIEF DESCRIPTION OF THE DRAWINGS

III. DETAILED DESCRIPTION OF THE PREFERRED EMBODIMENTS

Figure 1B:
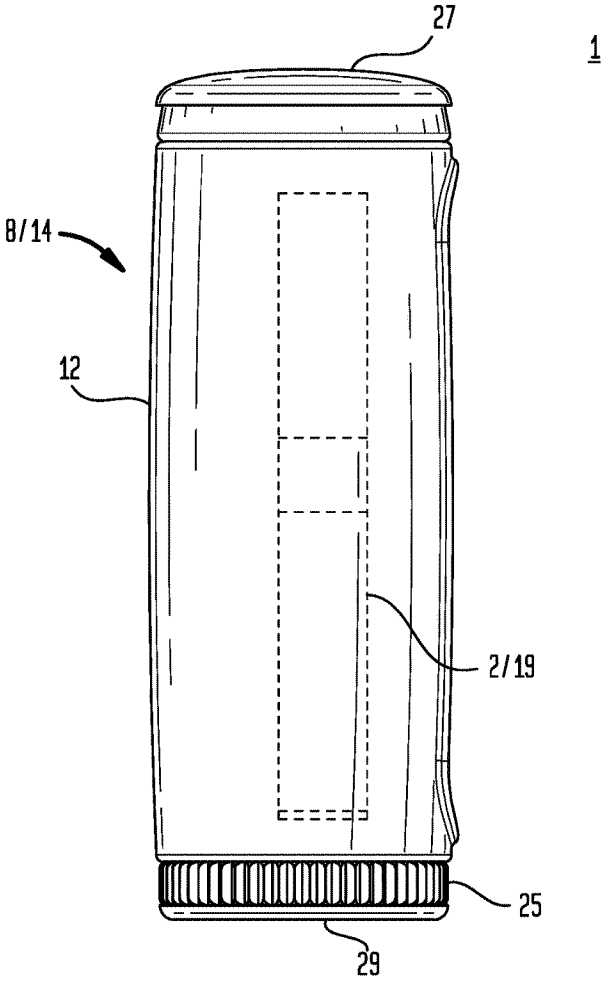
FIG. 1B is an illustration of the method of using the particular embodiment of the containment system shown in FIG. 1, but whereby the rotatable cover disposes in a second position to enclose the lateral cavity.
Figure 1A:
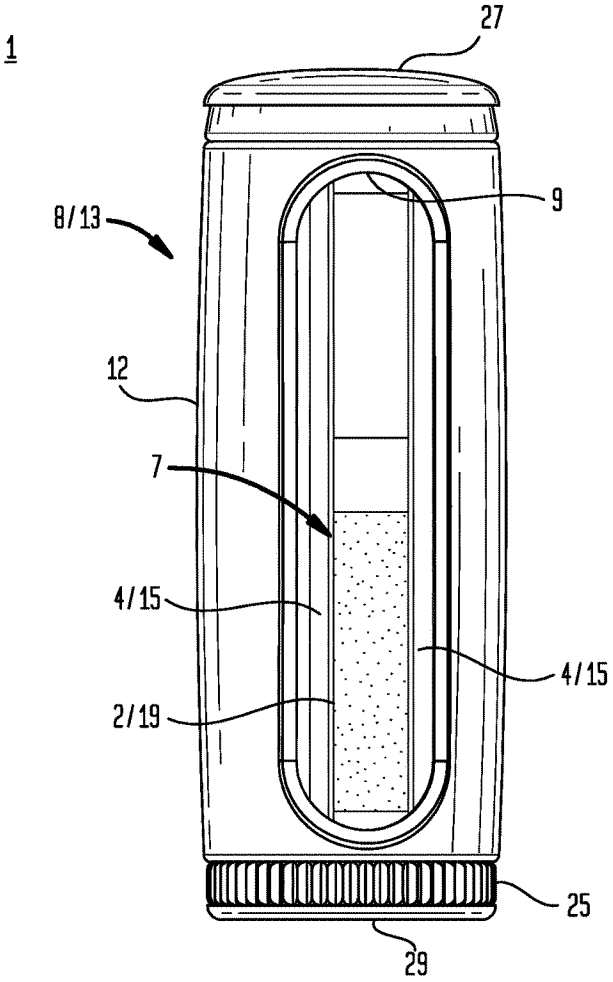
FIG. 1A is an illustration of a method of using a particular embodiment of the containment system to contain matter such as toiletries or cosmetics, whereby a rotatable cover of the containment system disposes in a first position to allow access to a lateral cavity disposed within a container sidewall of a container.
Figure 2:
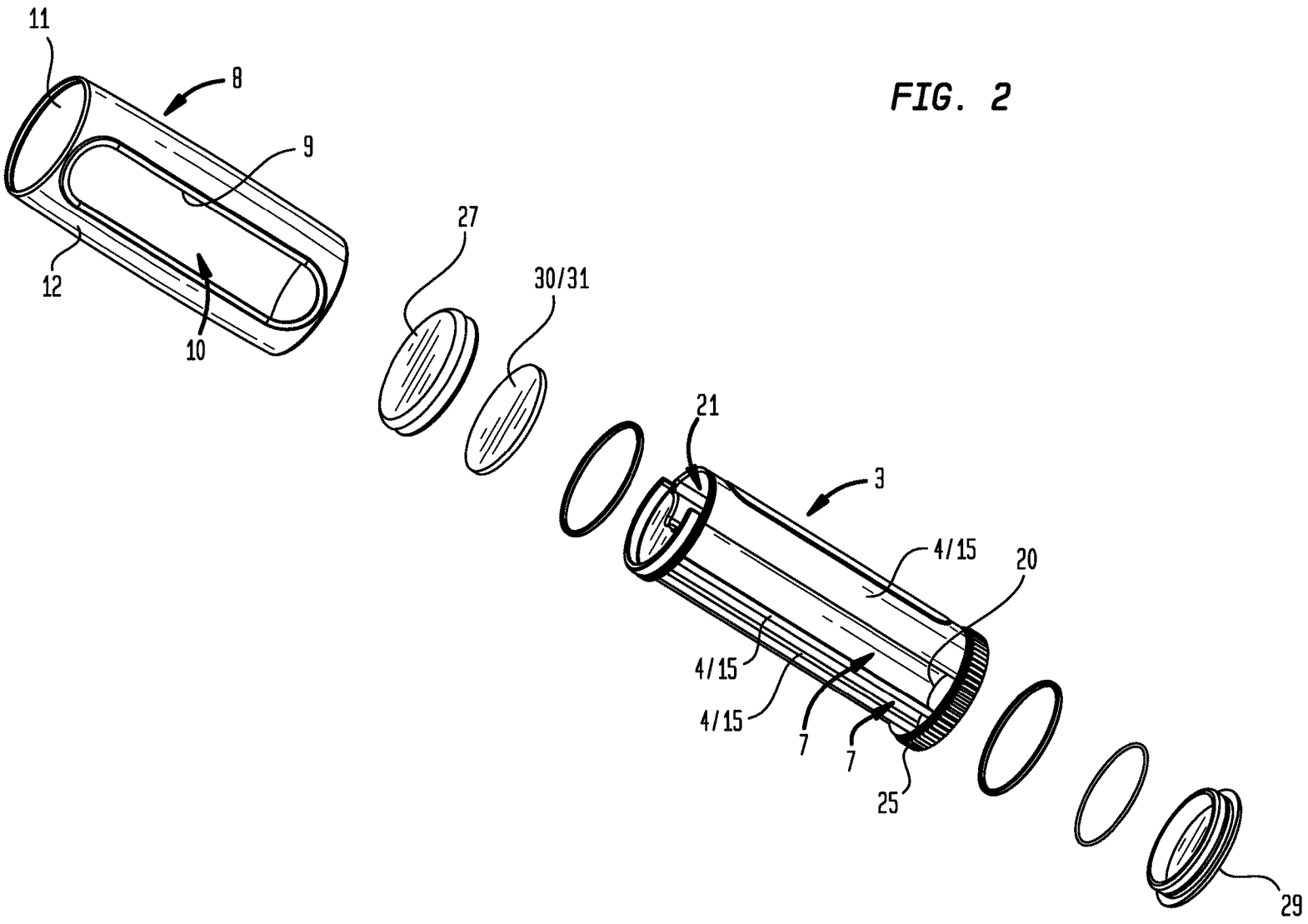
FIG. 2 is an exploded perspective view of a particular embodiment of the containment system.
Figure 3F:
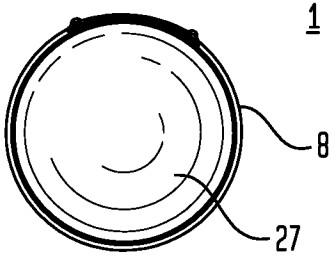
FIG. 3F is a first end view of the particular embodiment of the containment system shown in FIG. 3A.
Figure 3G:
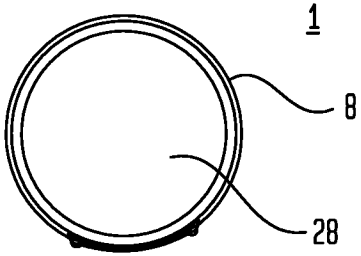
FIG. 3G is a second end view of the particular embodiment of the containment system shown in FIG. 3A.
Figure 3A:
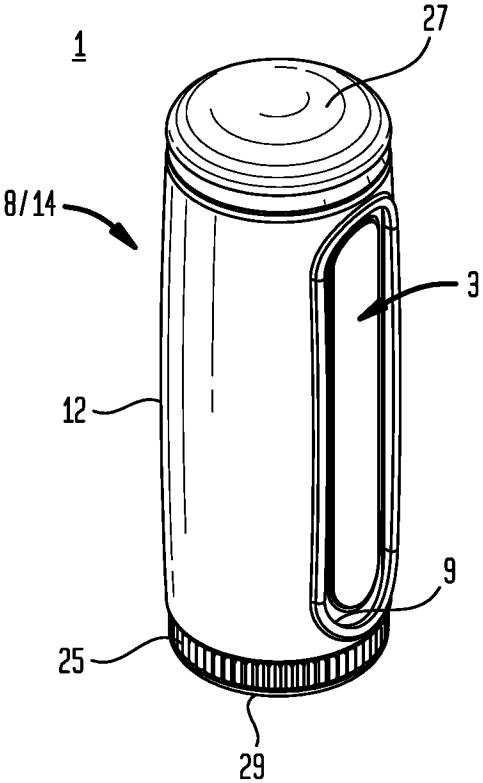
FIG. 3A is a perspective view of a particular embodiment of the containment system.
Figures 3B, 3C, 3D, 3E:
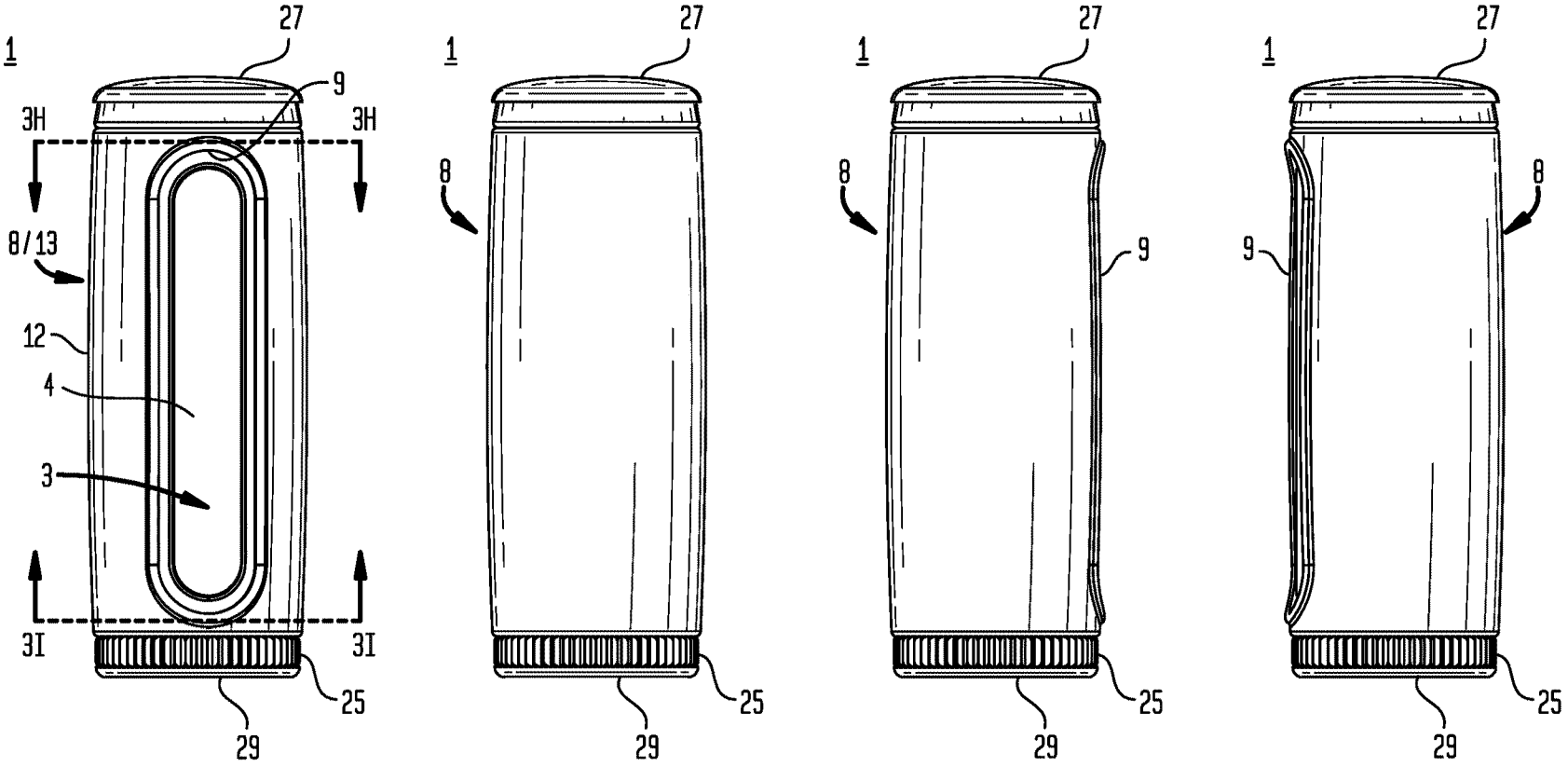
FIG. 3B is a front view of the particular embodiment of the containment system shown in FIG. 3A.
FIG. 3C is a rear view of the particular embodiment of the containment system shown in FIG. 3A.
FIG. 3D is a first side view of the particular embodiment of the containment system shown in FIG. 3A.
FIG. 3E is a second side view of the particular embodiment of the containment system shown in FIG. 3A.
Figure 3H:
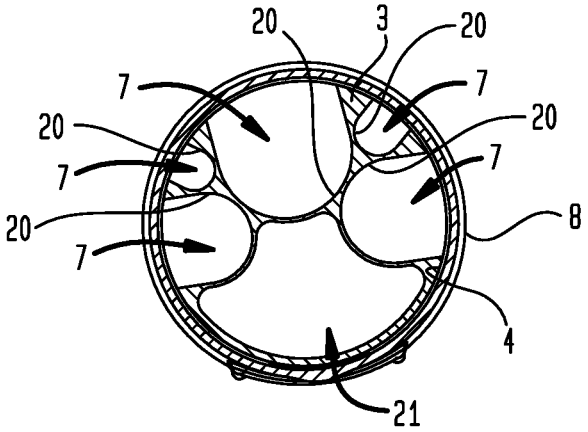
FIG. 3H is a cross sectional view 3H-3H of the particular embodiment of the containment system shown in FIG. 3B.
Figure 3I:
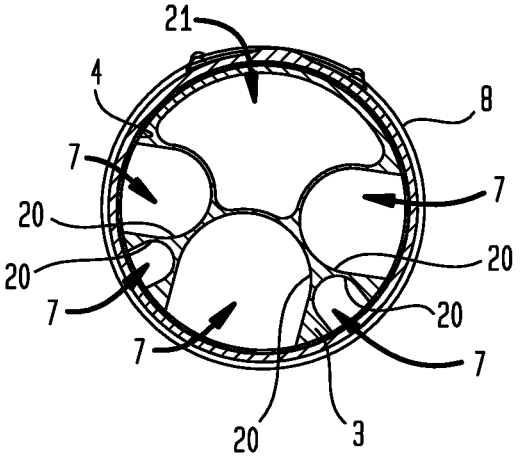
FIG. 3I is a cross sectional view 3I-3I of the particular embodiment of the containment system shown in FIG. 3B.

Now referring primarily to FIG. 1A and FIG. 1B, which illustrate a method of using a containment system (1) to contain matter (2), whereby the containment system (1) includes a container (3) having a container sidewall (4) disposed between opposing container first and second ends (5)(6); a lateral cavity (7) disposed in the container sidewall (4); a cover (8) concentrically disposed about the container sidewall (4); and an aperture element (9) disposed in the cover (8), the aperture element (9) defining an aperture element opening (10) communicating between cover inner and outer surfaces (11)(12).

Now referring primarily to FIG. 1A, the method of using the containment system (1) can include rotating the cover (8) about the container sidewall (4) to a first position (13) in which the aperture element opening (10) aligns with the lateral cavity (7) to allow access to the lateral cavity (7). Accordingly, matter (2) can be disposed within the lateral cavity (7) by passing the matter (2) through the aperture element opening (10).

Now referring primarily to FIG. 1B, the method of using the containment system (1) can further include rotating the cover (8) about the container sidewall (4) to a second position (14) in which a portion of the cover (8) overlays the lateral cavity (7) to enclose the lateral cavity (7), thereby precluding access to the lateral cavity (7) and correspondingly, to the matter (2) disposed within the lateral cavity (7). In this way, the matter (2) can be contained by the containment system (1).

Subsequently, the method of using the containment system (1) can further include rotating the cover (8) about the container sidewall (4) back to the first position (13), and retrieving the matter (2) from within the lateral cavity (7) by passing the matter (2) through the aperture element opening (10).

Now referring primarily to FIG. 2 through FIG. 5B, the containment system (1) includes a container (3) having a container sidewall (4) disposed between opposing container first and second ends (5)(6), whereby the container sidewall (4) can have any of a numerous and wide variety of configurations capable of accommodating a lateral cavity (7) and a rotatable cover (8). Thus, it should be understood that the invention can be practiced provided that at least a portion of the container sidewall (4) is arcuate.

Figure 4F:
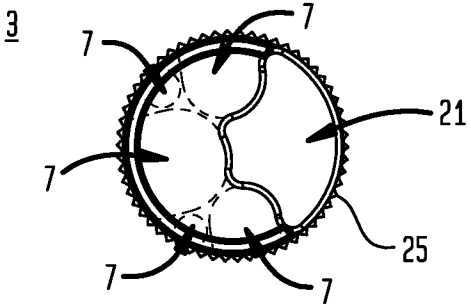
FIG. 4F is a first end view of the particular embodiment of the container shown in FIG. 4A.
Figure 4G:
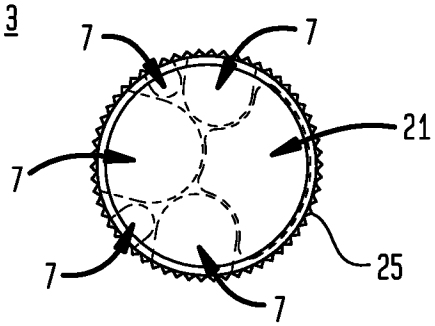
FIG. 4G is a second end view of the particular embodiment of the container shown in FIG. 4A.
Figure 4A:
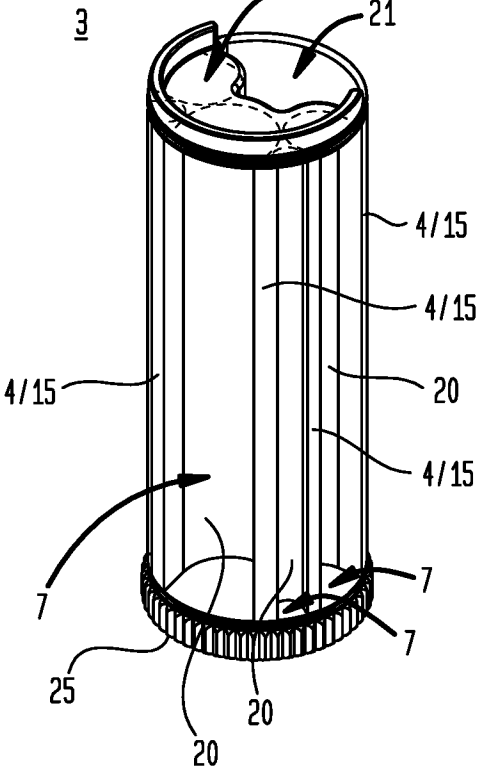
FIG. 4A is a perspective view of a particular embodiment of a container of the containment system.
Figure 4E:
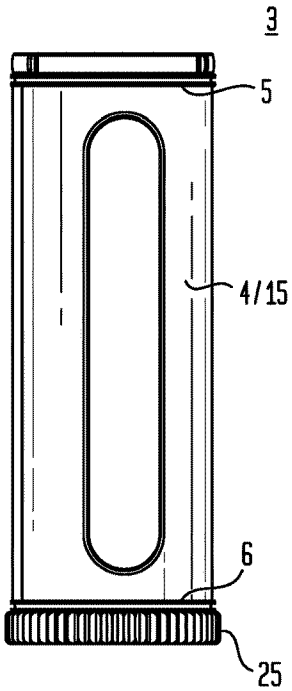
FIG. 4E is a second side view of the particular embodiment of the container shown in FIG. 4A.
Figure 4D:
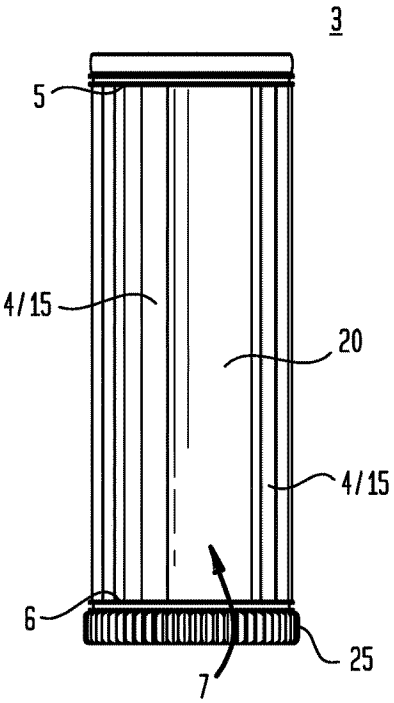
FIG. 4D is a first side view of the particular embodiment of the container shown in FIG. 4A.
Figure 4C:
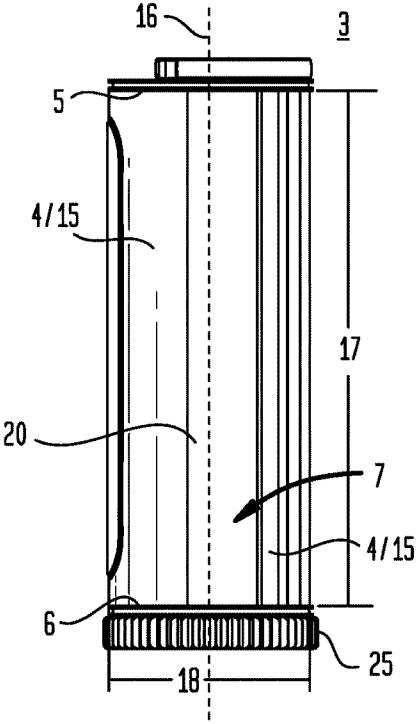
FIG. 4C is a rear view of the particular embodiment of the container shown in FIG. 4A.
Figure 4B:
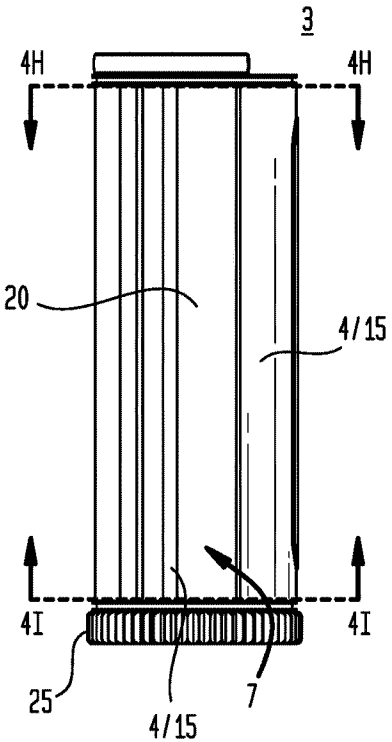
FIG. 4B is a front view of the particular embodiment of the container shown in FIG. 4A.
Figure 4H:
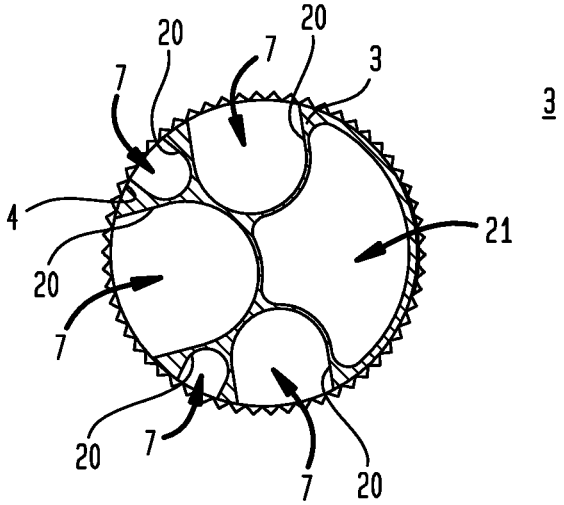
FIG. 4H is a cross sectional view 4H-4H of the particular embodiment of the container shown in FIG. 4B.
Figure 4I:
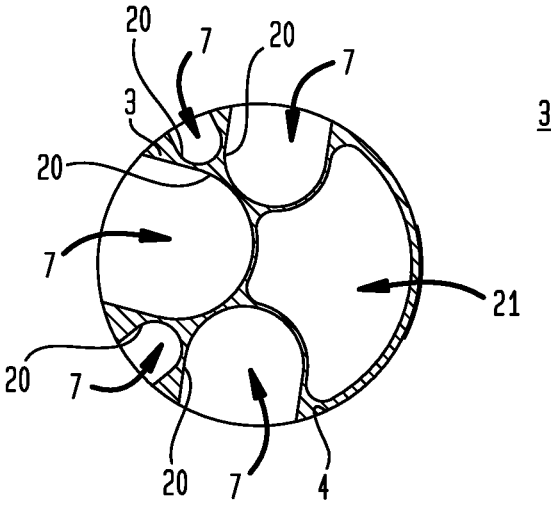
FIG. 4I is a cross sectional view 4I-4I of the particular embodiment of the container shown in FIG. 4B.

As to particular embodiments, the container sidewall (4) can be cylindrical or substantially cylindrical such that the container sidewall (4) can be defined by an arcuate container sidewall outer surface (15) which curves about a container sidewall longitudinal axis (16) (as shown in the example of FIG. 4C). Said another way, the container (3) and/or the container sidewall (4) can be configured as a cylinder. Correspondingly, the container (3) and/or the container sidewall (4) can have a circular or substantially circular cross section.

Now referring primarily to FIG. 4C, the container sidewall (4) has a container sidewall length (17) disposed between opposing container first and second ends (5)(6), and a container sidewall width (18) disposed between opposing points on the container sidewall outer surface (15). The container sidewall length and width (17)(18) can have any of a numerous and wide variety of dimensional relations, depending upon at least the matter (2) which the containment system (1) is intended to contain.

It is herein contemplated that, as to particular embodiments, the container sidewall width (18) can be generally uniform along the container sidewall length (17), thereby providing a cylindrical container sidewall (4) (as shown in the examples of the Figures).

It is also herein contemplated that, as to other particular embodiments, the container sidewall width (18) can vary along the container sidewall length (17), thereby providing a substantially cylindrical container sidewall (4) having a longitudinally-arcuate container sidewall outer surface (15) (not shown).

As but one illustrative example, the containment system (1) may be useful for containing matter (2) such as toiletries or cosmetics (19). Consequently, the container sidewall length and width (17)(18) can have dimensional relations which are suitable for containing toiletries or cosmetics (19), whereby the container sidewall length (17) can be about 15 centimeters and the container sidewall width (18) can be about 5 centimeters; however, it is noted that the invention need not be limited to this specific matter (2) nor these dimensional relations.

Now referring primarily to FIG. 4A through FIG. 4I, the containment system (1) further includes a lateral cavity (7) disposed in the container sidewall (4), meaning that the lateral cavity (7) is accessible via the container sidewall. As to particular embodiments, the lateral cavity (7) can be configured as a concavity which radially inwardly extends from the container sidewall outer surface (15), whereby the open end of the lateral cavity (7) through which matter (2) can be passed for disposition within the lateral cavity (7) can be substantially orthogonal to the container sidewall longitudinal axis (16).

The lateral cavity (7), which is bound by a cavity wall (20), can have any of a numerous and wide variety of configurations and volumes, depending upon at least the matter (2) which the containment system (1) is intended to contain and correspondingly, which the lateral cavity (7) is intended to receive.

As to particular embodiments, the lateral cavity (7) can be bound by an arcuate cavity wall (20) (as shown in the examples of the Figures), which may be useful for receiving matter (2) having a curved perimeter, such as many toiletries and cosmetics.

As to other particular embodiments, it is herein contemplated that the lateral cavity (7) can be bound by one or more planar or substantially planar cavity walls (20) (not shown).

As to particular embodiments, the lateral cavity (7) can be configured as an elongate lateral cavity (7) disposed along the container sidewall length (17), whereby an elongate lateral cavity longitudinal axis can be substantially parallel to the container sidewall longitudinal axis (16).

As to particular embodiments, it is herein contemplated that the cavity wall (20) which bounds the lateral cavity (7) can be formed from or can be overlaid with a resiliently compressible material which can compressingly engage with the matter (2) disposed within the lateral cavity (7) to releasably secure the matter (2) within the lateral cavity (7) (not shown).

Again referring primarily to FIG. 4A through FIG. 4I, as to particular embodiments, the containment system (1) can include a plurality of lateral cavities (7) which can contain a corresponding plurality of matters (2), whereby the plurality of lateral cavities (7) can have similar or varying configurations and volumes, depending upon at least the plurality of matters (2) which the containment system (1) is intended to contain and correspondingly, which the lateral cavities (7) are intended to receive.

As to particular embodiments, the plurality of lateral cavities (7) can be disposed within the container sidewall (4) in radially spaced apart relation, whereby each lateral cavity (7) radially inwardly extends from the container sidewall outer surface (15) such that the plurality of lateral cavities (7) occupy a portion of the interior of the container (3).

In at least this way, the instant containment system (1) differs from conventional containers having an interior compartment which is laterally surrounded by a container sidewall and accessed via a mouth proximate a container end.

Further, a conventional container having an interior compartment which is laterally surrounded by a container sidewall and accessed via a mouth proximate a container end could not be modified to arrive at the instant containment system (1) including the plurality of lateral cavities (7) disposed within the container sidewall (4) in radially spaced apart relation, as occupation of the interior of the container (3) by the plurality of lateral cavities (7) would likely preclude an interior compartment which, stated again, is laterally surrounded by a container sidewall and accessed via a mouth proximate a container end, from having a volume which is sufficient for containing a useful amount of matter (2), for example a useful amount of a fluid, such as a drinkable fluid. Thus, this type of modification may render a conventional container as described above inoperable for its intended purpose, particularly if an object of the conventional container is to provide an interior compartment which functions as a primary compartment.

Again referring primarily to FIG. 4A through FIG. 4I, as to particular embodiments, in addition to the lateral cavity (7), the containment system (1) can further include an axial cavity (21) disposed within the container (3), whereby the axial cavity (21) can be accessible via one or both of the container first and second ends (5)(6). As to particular embodiments, the axial cavity (21) can be configured as a concavity which axially inwardly extends from one or both of the container first and second ends (5)(6), whereby the open end of the axial cavity (21) through which matter (2) can be passed for disposition within the axial cavity (21) can be disposed in one or both of the container first and second ends (5)(6) and can be substantially parallel to the container sidewall longitudinal axis (16). Following, the axial cavity (21) can be laterally surrounded by the container sidewall (4).

As but one illustrative example, a particular embodiment of the containment system (1) can include an axial cavity (21) having an open end proximate a container first end (5) and a closed end proximate a container second end (6), whereby the axial cavity (21) can be laterally surrounded by the container sidewall (4) between the container first and second ends (5)(6).

Now referring primarily to FIG. 2, FIG. 3A through FIG. 3I, and FIG. 6A through FIG. 6G, the containment system (1) further includes a rotatable cover (8) configured for concentric disposition or concentrically disposed about the container sidewall (4), whereby the cover (8) can have any of a numerous and wide variety of configurations capable of concentric disposition about the container sidewall (4). As to particular embodiments, the cover (8) can be arcuate; accordingly, the cover (8) can be concentrically disposed about a portion or an entirety of an arcuate container sidewall (4).

As to particular embodiments, the cover (8) can be cylindrical or substantially cylindrical. Thus, the cover (8) can concentrically dispose about a corresponding cylindrical or substantially cylindrical container (3) and/or container sidewall (4), whereby both the container (3) and/or container sidewall (4) and the cover (8) can have a circular or substantially circular cross section.

Figure 6F:
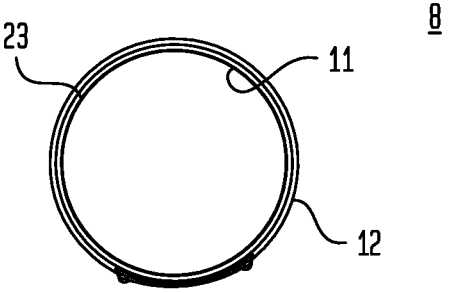
FIG. 6F is a first end view of the particular embodiment of the rotatable cover shown in FIG. 6A.
Figure 6G:
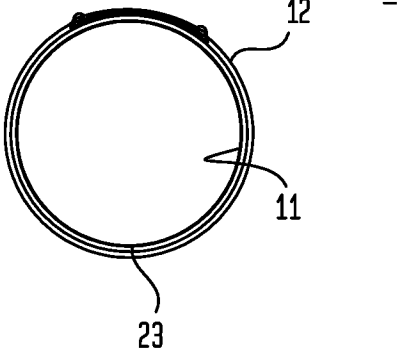
FIG. 6G is a second end view of the particular embodiment of the rotatable cover shown in FIG. 6A.
Figure 6A:
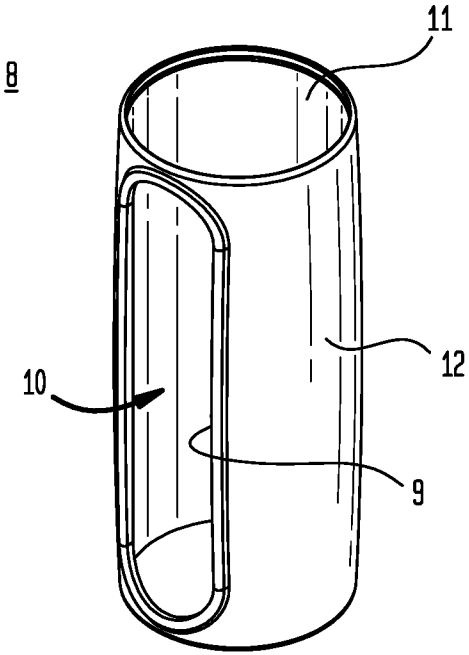
FIG. 6A is a perspective view of a particular embodiment of a rotatable cover of the containment system.
Figure 6B:
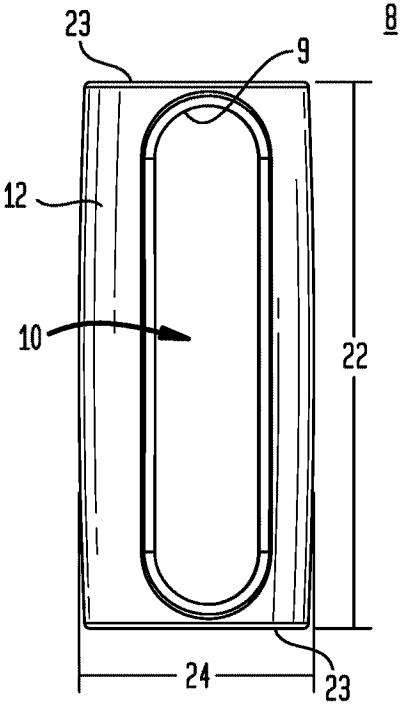
FIG. 6B is a front view of the particular embodiment of the rotatable cover shown in FIG. 6A.
Figure 6C:
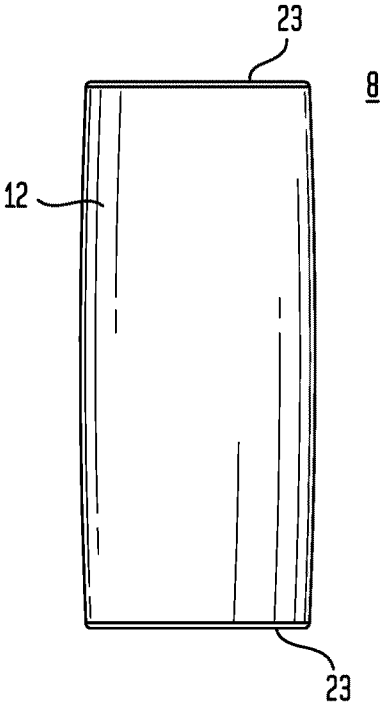
FIG. 6C is a rear view of the particular embodiment of the rotatable cover shown in FIG. 6A.
Figure 6D:
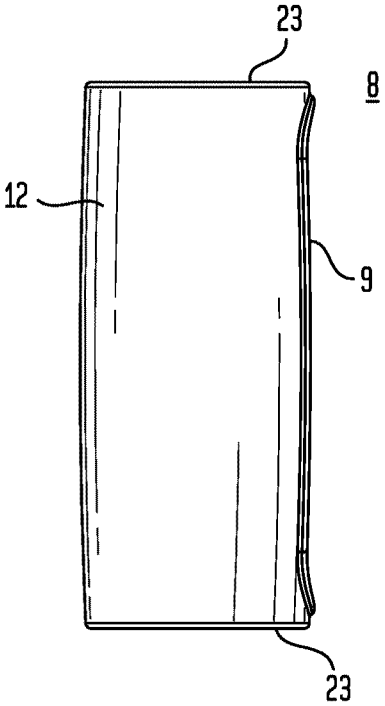
FIG. 6D is a first side view of the particular embodiment of the rotatable cover shown in FIG. 6A.
Figure 6E:
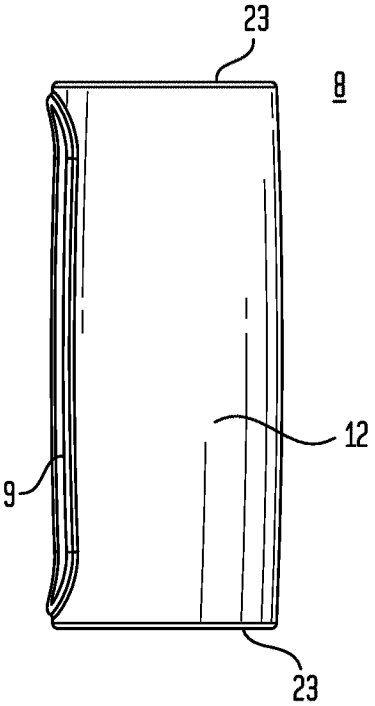
FIG. 6E is a second side view of the particular embodiment of the rotatable cover shown in FIG. 6A.

Now referring primarily to FIG. 6B, the cover (8) has a cover length (22) disposed between opposing cover ends (23) and a cover width (24) disposed between opposing points on the cover outer surface (12), whereby the cover length and width (22)(24) can have any of a numerous and wide variety of dimensional relations, depending upon at least the dimensional relations of the container sidewall (4) about which the cover (8) is intended to concentrically dispose.

As to particular embodiments, the configuration and dimensional relations of the cover (8) can be sufficient to frictionally engage the cover (8) with the container sidewall (4) such that the cover (8) is coupled to the container sidewall (4) only via the frictional engagement. As such, there are no extraneous couplers or connectors which attach the cover (8) to the container sidewall (4). The frictional engagement can be overcome upon the application of forces to rotate the cover (8) about the container sidewall (4).

As to particular embodiments, it is herein contemplated that the cover (8) can be guided in its rotation about the container sidewall (4) by one or more channels and following members which preclude movement of the cover (8) along the container sidewall longitudinal axis (16) (not shown). As to particular embodiments, the channel can run generally horizontally around the container sidewall outer surface (15) and the following member can protrude from the cover inner surface (11) for receipt within the channel. As to other particular embodiments, the channel can run generally horizontally around the cover inner surface (11) and the following member can protrude from the container sidewall outer surface (15) for receipt within the channel. It is further herein contemplated that the following member may lock in the channel to preclude the cover (8) from disengaging from the container sidewall (4).

Again referring primarily to FIG. 2, FIG. 3A through FIG. 3I, and FIG. 6A through FIG. 6G, the cover (8) further includes an aperture element (9) which defines an aperture element opening (10) communicating between the cover inner and outer surfaces (11)(12).

The aperture element (9) can have any of a numerous and wide variety of configurations and dimensional relations, depending upon at least the matter (2) which the containment system (1) is intended to contain, as the matter (2) must pass through the aperture element opening (10) to ingress to or egress from the lateral cavity (7).

Now referring primarily to FIG. 1A and FIG. 1B, the cover (8) is rotatable about the container sidewall (4) between first and second positions (13)(14). In the first position (13), the aperture element opening (10) aligns with the lateral cavity (7) to allow access to the lateral cavity (7) via an open end of the lateral cavity (7). Accordingly, the matter (2) can be passed through the aperture element opening (10) to ingress to or egress from the lateral cavity (7). Conversely, in the second position (14), a portion of the cover (8) overlays the lateral cavity (7) to enclose the lateral cavity (7), thereby precluding access to the lateral cavity (7) and correspondingly, to the matter (2) disposed within the lateral cavity (7). In this way, the matter (2) can be contained by the containment system (1).

As to particular embodiments, the containment system (1) can, but need not necessarily, further include one or more stop elements which preclude or stop rotation of the cover (8) about the container sidewall (4) (not shown). As but one illustrative example, the stop element can be configured as a catch which outwardly extends from the container sidewall outer surface (15) and a catch-receiving element bound by opposing catch-receiving element walls which outwardly extend from the cover inner surface (11).

Upon rotation of the cover (8) to achieve the second position (14), the catch can be received within the catch-receiving element to preclude or stop rotation of the cover (8) about the container sidewall (4), thereby securing or locking the cover (8) in the second position (14) to enclose the lateral cavity (7) and contain the matter (2) disposed within the lateral cavity (7).

In contrast, upon rotation of the cover (8) toward the first position (13), the catch can be disengaged from within the catch-receiving element, for example via the application of forces which rotate the cover (8) about the container sidewall (4).

Now referring primarily to FIG. 3A through FIG. 4H, as to particular embodiments, the containment system (1) can, but need not necessarily, further include a grippable element (25) coupled to, directly coupled to, connected to, or integrated with the container sidewall (4) to axially extend from one or both container ends (5)(6), whereby the grippable element (25) may be useful for grippably engaging the container sidewall (4) to facilitate rotation of the cover (8) about the container sidewall (4).

Figure 5A:
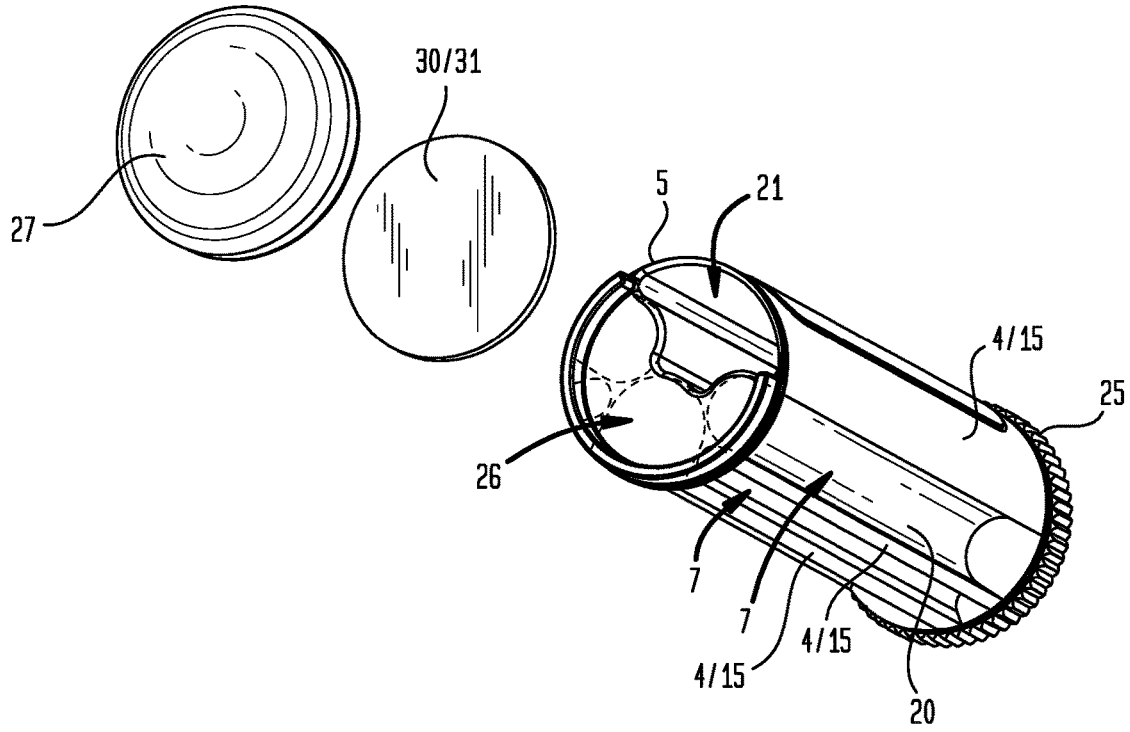
FIG. 5A is an exploded perspective view of a particular embodiment of the containment system, whereby a first cap and an auxiliary element configured as a reflective element are exploded off from a first end of a container.

Now referring primarily to FIG. 5A, the containment system (1) can, but need not necessarily, further include a first axial compartment (26) coupled to, directly coupled to, connected to, or integrated with the container first end (5), whereby the first axial compartment (26) can be enclosed by a first end cap (27) which removably couples to the container first end (5), for example via frictional or threaded engagement.

As to particular embodiments of the containment system (1) including an axial cavity (21) having an open end proximate the container first end (5), a closed end proximate the container second end (6), and laterally surrounded by the container sidewall (4) between the container first and second ends (5)(6), the first end cap (27) can also enclose the axial cavity (21) upon removably coupling to the container first end (5).

Figure 5B:
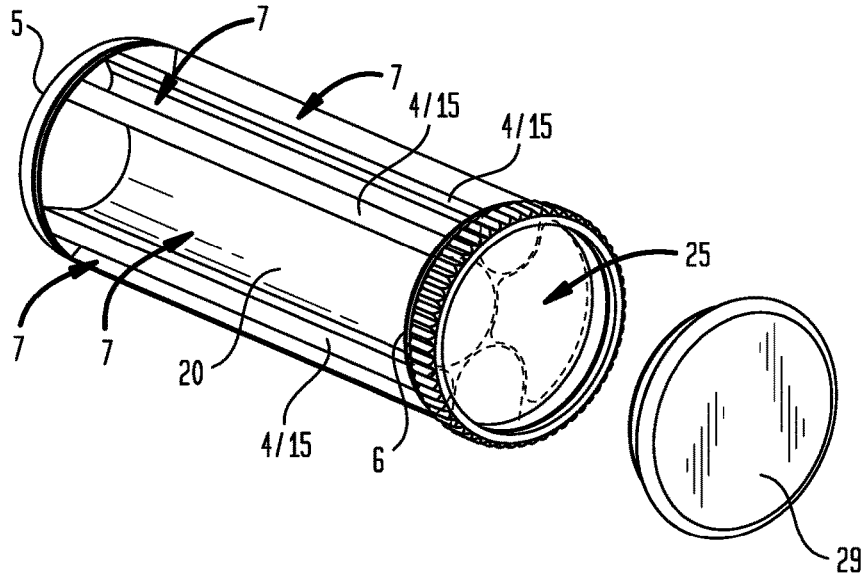
FIG. 5B is an exploded perspective view of a particular embodiment of the containment system, whereby a second cap is exploded off from a second end of a container.

Now referring primarily to FIG. 5B, the containment system (1) can, but need not necessarily, further include a second axial compartment (28) coupled to, directly coupled to, connected to, or integrated with the container second end (6), whereby the second axial compartment (28) can be enclosed by a second end cap (29) which removably couples to the container second end (6), for example via frictional or threaded engagement.

Now referring primarily to FIG. 5A, the containment system (1) can, but need not necessarily, further include an auxiliary element (30) coupled to, directly coupled to, connected to, or integrated with at least one of the first and second end caps (27)(29).

As but one illustrative example, the auxiliary element (30) can comprise a reflective element (31), such as a mirror (as shown in the examples of the Figures).

As another illustrative example, the auxiliary element (30) can comprise a light or a lighted mirror (not shown).

A method of making the containment system (1) detailed above includes providing a container (3) including a container sidewall (4) disposed between opposing container first and second ends (5)(6), and a lateral cavity (7) disposed in the container sidewall (4); and providing a cover (8) configured to concentrically dispose about the container sidewall (4), whereby the cover (8) includes an aperture element (9) disposed in the cover (8), the aperture element (9) defining an aperture element opening (10) which communicates between cover inner and outer surfaces (11)(12).

The method of making the containment system (1) can further include providing additional components of the containment system (1), as described above and in the claims.

Regarding production, the containment system (1) or components of the containment system (1) can be made from any of a numerous and wide variety of processes depending upon the application, such as molding, press molding, injection molding, fabrication, machining, printing, additive printing, or the like, or combinations thereof, as one piece or assembled from a plurality of pieces into an embodiment of the containment system (1).

Further regarding production, the containment system (1) or components of the containment system (1) can be made from any of a numerous and wide variety of materials depending upon the application, such as semi-rigid or rigid materials which can include as non-limiting examples: metal, wood, plastic, plastic-like material, or the like, or combinations thereof.

As to particular embodiments, the cover (8) can be made from a translucent or transparent material, which may permit viewing of the matter (2) disposed within the lateral cavity (7) when the lateral cavity (7) is enclosed by a portion of the cover (8).

As can be easily understood from the foregoing, the basic concepts of the present invention may be embodied in a variety of ways. The invention involves numerous and varied embodiments of a containment system and methods for making and using such a containment system.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "container" should be understood to encompass disclosure of the act of "containing"—whether explicitly discussed or not—and, conversely, were there effectively disclosure of the act of "containing", such a disclosure should be understood to encompass disclosure of a "container" and even a "means for containing". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Thus, the applicant(s) should be understood to claim at least: i) each of the containment systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A containment system comprising:

a container having a container sidewall disposed between opposing container first and second ends;

a lateral cavity disposed in said container sidewall;

a cover configured for concentric disposition about said container sidewall; and an aperture element disposed in said cover, said aperture element defining an aperture element opening communicating between cover inner and outer surfaces;

wherein said cover is rotatable about said container sidewall between first and second positions;

wherein in said first position, said aperture element opening aligns with said lateral cavity, thereby allowing access to said lateral cavity; and wherein in said second position, a portion of said cover overlays said lateral cavity to enclose said lateral cavity.

2. The containment system of claim 1, wherein said container sidewall comprises an arcuate container sidewall outer surface.

3. The containment system of claim 2, wherein said container sidewall is substantially cylindrical.

4. The containment system of claim 3, wherein said container sidewall comprises a substantially circular cross section.

5. The containment system of claim 1, wherein said lateral cavity disposes along a container sidewall length of said container sidewall.

6. The containment system of claim 1, wherein said lateral cavity comprises a concavity which radially inwardly extends from said container sidewall outer surface.

7. The containment system of claim 6, wherein said lateral cavity is bound by an arcuate lateral cavity wall.

8. The containment system of claim 6, wherein said lateral cavity comprises an elongate lateral cavity disposed along a container sidewall length of said container sidewall.

9. The containment system of claim 1, further comprising a plurality of said lateral cavities disposed in said container sidewall in radially spaced apart relation.

10. The containment system of claim 1, further comprising an axial cavity disposed within said container, said axial cavity accessible via at least one of said container first and second ends.

11. The containment system of claim 1, wherein said cover is arcuate.

12. The containment system of claim 11, wherein said cover concentrically disposed about an entirety of said container sidewall.

13. The containment system of claim 11, wherein said cover is generally cylindrical.

14. The containment system of claim 1, wherein said cover frictionally engages with said container sidewall.

15. The containment system of claim 1, further comprising a grippable element coupled to said container sidewall to axially extend from at least one of said container first and second ends.

16. The containment system of claim 1, further comprising:

a first axial compartment coupled to said container first end; and a first end cap which removably couples to said container first end to enclose said first axial compartment.

17. The containment system of claim 16, further comprising:

a second axial compartment coupled to said container second end; and a second end cap which removably couples to said container second end to enclose said second axial compartment.

18. The containment system of claim 17, further comprising an auxiliary element coupled to at least one of said first and second end caps.

19. The containment system of claim 18, wherein said auxiliary element comprises a reflective element.

20. The containment system of claim 1, wherein said cover is formed from a translucent or transparent material.

* * * * *